US005950153A

United States Patent [19]

Ohmori et al.

[11] Patent Number: 5,950,153

[45] Date of Patent: Sep. 7, 1999

[54] AUDIO BAND WIDTH EXTENDING SYSTEM AND METHOD

[75] Inventors: Shiro Ohmori; Masayuki Nishiguchi, both of Kanagawa, Japan

[73] Assignee: Sony Corporation, Tokyo, Japan

[21] Appl. No.: 08/951,029

[22] Filed: Oct. 15, 1997

[30] Foreign Application Priority Data

Oct. 24, 1996 [JP] Japan ..... 8-282234

[51] Int. Cl.[6] ..... G10L 9/08

[52] U.S. Cl. ..... 704/217; 704/219

[58] Field of Search ..... 704/200, 219, 704/222, 223, 217, 500, 503, 216, 218

[56] References Cited

U.S. PATENT DOCUMENTS 5,271,088 12/1993 Bahler ..... 704/200
5,455,888 10/1995 Iyengar et al. ..... 395/212
5,581,652 12/1996 Abe et al. ..... 704/222
5,778,335 7/1998 Ubale et al. ..... 704/219
5,787,390 7/1998 Quinquis et al. ..... 704/219

FOREIGN PATENT DOCUMENTS 0658876 12/1994 European Pat. Off. ..... G10L 9/14

*Primary Examiner*—Richemond Dorvil
*Attorney, Agent, or Firm*—Jay H. Maioli

[57] ABSTRACT

A narrow band code book in which parameters of a time region of a narrow band audio signal obtained from patterns of a plurality of audio signals have previously been stored and a wide band code book in which parameters of a time region of a wide band audio signal obtained from the patterns of a plurality of audio signals have previously been stored in correspondence to the code book of the narrow band, and the input narrow band audio signal is analyzed by the narrow band code book and is synthesized by the wide band code book. In this system, an autocorrelation is used on the parameters of the code books, and a signal obtained by up-sampling an linear predictive code residual is used as an exciting source at the time of audio synthesis.

13 Claims, 6 Drawing Sheets

AUDIO BAND WIDTH EXTENDING SYSTEM AND METHOD

BACKGROUND OF THE INVENTION

1. Field of the Invention

The invention relates to bandwidth extending system for an audio signal and a method for generating an audio signal of a wide band from an audio signal whose frequency band is limited to a narrow band by being transmitted through a transmission path such as a telephone line or the like.

2. Description of the Related Art

A band of a telephone line is so narrow to be, for example, 300 to 3400 kHz and a frequency band of an audio signal that is transmitted through the telephone line is limited. Therefore, a sound quality of the conventional analog telephone line is not good. There is also a dissatisfaction about a sound quality of a digital cellular phone.

Various systems for extending an audio band width on the reception side and improving a sound quality have been proposed. Among them, there has been proposed a system such that a narrow band code book in which parameters of a narrow band audio signal derived from patterns of a plurality of audio signals have previously been stored as code vectors and a wide band code book in which parameters of a wide band audio signal derived from the patterns of the same audio signals as those signals have previously been stored as code vectors are prepared, an input signal is analyzed by the narrow band code book, and an audio synthesis is performed by using the wide band code book on the basis of the analysis result, thereby extending an audio band width and improving a sound quality.

That is, as shown in FIG. 6, in case of transmitting an audio signal through a transmission path like a telephone line, a frequency band of the audio signal from a speech side 101 is limited because it is transmitted through a transmission path 102. For example, even if the frequency band of the audio signal from the speech side 101 lies within a range from about 300 Hz to 7000 Hz, so long as it is transmitted via the transmission path 102, a frequency band of an audio signal to be sent to a reception side 103 is limited to a frequency within a range, for example, from about 300 Hz to 3400 Hz.

Therefore, as shown in FIG. 7, a narrow band code book 105 in which parameters of a narrow band audio signal which are derived from patterns of a plurality of audio signals have previously been stored as code vectors and a wide band code book 106 in which parameters of a wide band audio signal obtained from the patterns of the same audio signal have previously been stored in correspondence to the narrow band code book 105 are prepared.

The code books 105 and 106 are formed by, for instance, dividing the same wide band audio signals into frames each having a predetermined length, forming patterns of a plurality of audio signals, and analyzing a spectrum envelope every frame. That is, when the code books are formed, the wide band audio signal is used and the wide band audio signal is divided every predetermined frame. Spectrum envelope information when the wide band audio signal is analyzed as a wide band is stored as code vectors into the wide band code book 106. Spectrum envelope information when the wide band audio signal is band limited to, for example, 300 to 3400 Hz and analyzed is stored as code vectors into the narrow band code book 105.

As spectrum envelope information to be stored in the narrow band code book 105 and wide band code book 106, an LPC cepstrum has been used hitherto. The LPC cepstrum formed is a cepstrum by linear predictive coefficients and is obtained as shown in the following equations (1).

$$\begin{cases} c_1 = -\alpha_1 \\ c_n = -\alpha_n - \sum_{m=1}^{n-1}\left(1-\frac{m}{n}\right)\alpha_m c_{n-m} \quad (1 < n \leqq p) \\ c_n = -\sum_{m=1}^{p}\left(1-\frac{m}{n}\right)\alpha_m c_{n-m} \end{cases} \tag{1}$$

p: linear predictive degree

In FIG. 7, the narrow band audio signal sent from the speech side 101 to the reception side 103 through the transmission path 102 is first sent to an analyzing circuit 104. In the analyzing circuit 104, the input audio signal is divided every predetermined number of frames and a spectrum envelope is obtained. An output of the analyzing circuit 104 is sent to the narrow band code book 105. In the narrow band code book 105, the spectrum envelope analyzed by the analyzing circuit 104 and the spectrum envelope information stored in the narrow band code book 105 are compared, thereby performing a matching process. An output of the narrow band code book 105 is sent to the wide band code book 106. The spectrum envelope information of the wide band corresponding to the most matched spectrum envelope information in the narrow band code book 105 is read out from the wide band code book 106.

The wide band spectrum envelope information is sent to a synthesizing circuit 107. In the synthesizing circuit 107, the audio signal is synthesized by using the wide band spectrum envelope information read out from the wide band code book 106. Thus the synthesized audio signal becomes the wide band audio signal because it is synthesized by using the wide band code book 106.

As mentioned above, in the conventional audio band width extending system, the LPC cepstrum is used as code vectors. Noises and a pulse train are used as an exciting source when the audio signal is synthesized. In the LPC cepstrum, however, although the auditory distortion and the quantization error relatively coincide, since a logarithm scale is used, importance is attached to a portion of small energy as compared with the case of using a linear scale. An error increases in a portion of a large energy. In case of using the LPC cepstrum in such an audio band width extending system, it is preferable to auditorily suppress a distortion in a vowel sound portion. Therefore, the LPC cepstrum is not always optimum. With respect to the exciting source, although a source that is as close as the LPC residual of the wide band ought to be good, the conventional system using the noises and pulse train is far from it.

OBJECTS AND SUMMARY OF THE INVENTION

It is, therefore, an object of the invention to provide an audio bandwidth extending system and method which can more preferably perform an audio bandwidth extension by making the information which the code book has and the exciting source more suitable.

According to the invention, there is provided an audio bandwidth extending system characterized by comprising: analyzing means for obtaining parameters of a time region from an input narrow band audio signal; exciting source forming means for obtaining an exciting source from the input narrow band audio signal; a narrow band code book in which the parameters of the time region of the narrow band audio signal obtained from patterns of a plurality of audio signals have previously been stored; a wide band code book in which parameters of a time region of a wide band audio signal obtained from patterns of the plurality of audio signals have previously been stored in correspondence to the code book of the narrow band; matching means for comparing the parameters of the time region of the audio signal of the input narrow band with the parameters of the time region of the input narrow band audio signal stored in the narrow band code book and for retrieving an optimum parameter; and synthesizing means for reading out a corresponding parameter from the parameters of the time region of the wide band audio signal stored in the wide band code book on the basis of a retrieval result by the matching means and for synthesizing an output wide band audio signal on the basis of the exciting source formed by the exciting source forming means and the read-out parameter.

According to the invention, an autocorrelation is used as parameters of the time region. When an output audio signal is synthesized by using a parameter of the wide band audio signal read out from the wide band code book, a signal obtained by up-sampling the LPC residual is used as an exciting source.

As mentioned above, the narrow band code book in which the parameters of the time region of the narrow band audio signal obtained from the patterns of a plurality of audio signals have previously been stored and the wide band code book in which the parameters of the time region of the wide band audio signal derived from the pattern of a plurality of audio signals have previously been stored in correspondence to the code book of the narrow band are prepared, the analysis is performed by the narrow band code book, and the synthesis is executed by the wide band code book. In this instance, the autocorrelation is used as parameters of the code book and the signal obtained by up-sampling the LPC residual is used for the audio synthesis. When the autocorrelation is used, the error in a vowel sound having a large power is reduced and a good audio signal can be synthesized.

The above, and other, objects, features and advantages of the present invention will become readily apparent from the following detailed description thereof which is to be read in connection with the accompanying drawings.

DETAILED DESCRIPTION OF THE PREFERRED EMBODIMENTS

Figure 1:
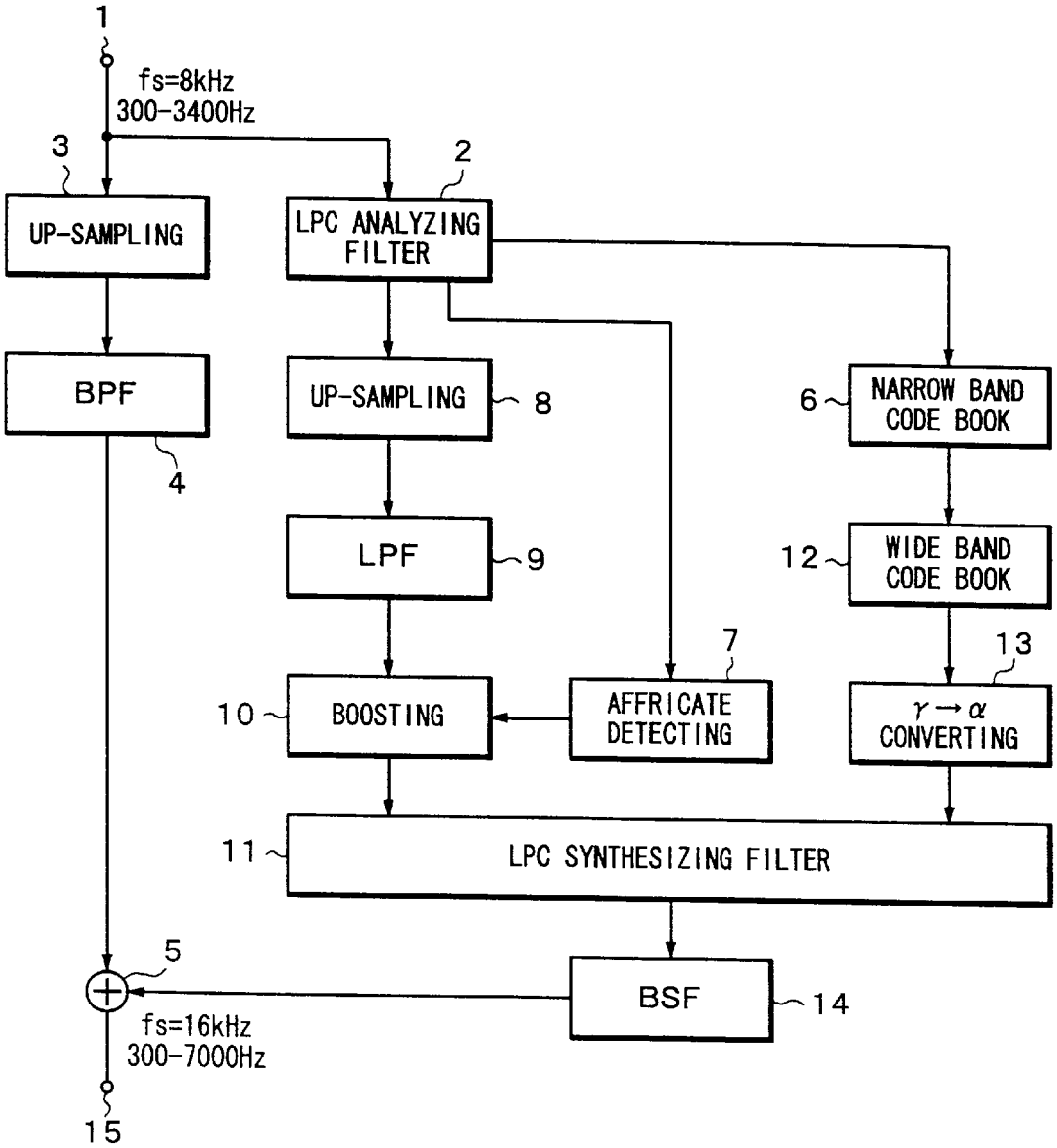
FIG. 1 is a block diagram showing a construction of an audio bandwidth extending system to which the invention is applied.

An embodiment of the invention will now be described hereinbelow with reference to the drawings. FIG. 1 shows an example of an audio band width extending system to which the invention is applied. In FIG. 1, a narrow band audio signal in which a frequency band lies within a range of, for example, 300 Hz to 3400 Hz and a sampling frequency equal to 8 kHz are supplied to an input terminal 1. The narrow band audio signal is supplied to an LPC (Linear Predictive Coding) analyzing filter 2 and is also supplied to an up-sampling circuit 3.

The up-sampling circuit 3 is used to up-sample a sampling frequency from 8 kHz to 16 kHz. An output of the up-sampling circuit 3 is supplied to an adding circuit 5 through a band pass filter 4 of a pass band in a range from 300 Hz to 3400 Hz. As will be explained below, a path along the up-sampling circuit 3, band pass filter 4, and adding circuit 5 is a path for adding a signal of components of the original frequency band to an audio signal of a high band which was audio synthesized.

The LPC analyzing filter 2 divides a narrow band audio signal from the input terminal 1 into frames and executes an LPC analysis of degree 10. An autocorrelation of degree 10 is obtained in the LPC analyzing step. The autocorrelation is sent to a narrow band code book 6 and is also sent to an affricate detecting circuit 7. The LPC residual obtained by the LPC analyzing filter 2 is sent to an up-sampling circuit 8.

The LPC residual of the audio of the narrow band is up-sampled by the up-sampling circuit 8. An output of the up-sampling circuit 8 is sent to an LPC synthesizing filter 11 through a low pass filter 9 and a boosting circuit 10. A signal obtained by up-sampling the LPC residual and suppressing a high band is used as an exciting source when synthesizing the audio signal as will be explained below. The boosting circuit 10 is used to boost the exciting source when an affricate and a fricative sound are detected. A boost amount of the boosting circuit 10 is controlled by an output of the affricate detecting circuit 7.

Autocorrelation information of degree 10 of the narrow band audio signal derived from the patterns of a plurality of audio signals has previously been stored as code vectors in the narrow band code book 6. In the narrow band code book 6, the autocorrelation derived from the LPC analyzing filter 2 and autocorrelation information previously stored in the narrow band code book 6 are compared, thereby performing a matching process. An index of the most matched autocorrelation information is sent to the wide band code book 12.

Autocorrelation information of degree 20 of a wide band audio signal obtained from an audio signal of the same patterns as those used when the narrow band code book 6 was formed has been stored as code vectors in the wide band code book 12 in correspondence to the narrow band code book 6. When the most matched autocorrelation information is discriminated in the narrow band code book 6, the index is sent to the wide band code book 12. Autocorrelation information of the wide band corresponding to the autocorrelation information of the narrow band which was discriminated as being maximally matched is read out from the wide band code book 12.

The autocorrelation is a parameter of the time region and is obtained as follows.

$$r_\tau = \sum_{t=0}^{N-1-\tau} X_t X_{t-\tau} \qquad (\tau \geqq \phi) \tag{2}$$

$$\{X_t\} = \{X_0, X_1, \ldots X_{N-1}\}$$

N: the number of audio samples

The wide band code book 12 is formed as follows by using a wide band audio signal of 0 to 8000 kHz in which a sampling frequency is equal to 16 kHz. That is, when the wide band code book 12 is formed, the wide band audio signal is divided into frames of a length of 32 msec and every advanced 20 msec and an autocorrelation of degree 20 is obtained in each frame. By using it, a code book of eight bits is formed by a GLA (General Lloyd Algorithm) algorithm. This code book is used as a wide band code book 4. A frame No. encoded to the i-th code vector in the wide band code book assumes Ai.

The narrow band code book 6 is formed by using the audio signal which is the same as the signal used when forming the wide band code book 12 and in which a sampling frequency is equal to 8 kHz and a frequency band is limited from 300 Hz to 3400 Hz. The audio signal which was limited to the narrow band is divided into frames at the same time as the time when the wide band code book 12 is formed, thereby obtaining an autocorrelation of degree 10 in each frame. A center of gravity of the narrow band autocorrelation of the frame which belongs to the frame No. Ai is obtained and the vectors are set to the i-th code vector of the narrow band code book, thereby corresponding to the wide band autocorrelation of the wide band code book of the frame No. Ai.

In FIG. 1, the autocorrelation information of the wide band read out from the wide band code book 12 is sent to an autocorrelation—linear predictive coefficient converting circuit 13. A conversion from the autocorrelation to the linear predictive coefficients is performed by the autocorrelation—linear predictive coefficient converting circuit 13. The linear predictive coefficients are sent to the LPC synthesizing filter 11.

A signal in which the LPC residual from the LPC analyzing filter 2 is up-sampled by the up-sampling circuit 8 and an aliasing distortion is generated and the high band side is suppressed by transmitting the signal through the low pass filter 9 is supplied to the LPC synthesizing filter 11. In the LPC synthesizing filter 11, a signal such that the LPC residual is up-sampled and the high band side of the aliasing distortion is suppressed is used as an exciting source and an LPC synthesis is executed by the linear predictive coefficients from the autocorrelation—linear predictive coefficient converting circuit section 13. Thus, the audio signal of a wide band from 300 Hz to 7000 Hz is synthesized.

The audio signal synthesized by the LPC synthesizing filter 11 is supplied to a band stop filter 14. The band stop filter 14 eliminates signal components in the frequency band of the input narrow band audio signal. In the band stop filter 14, signal components from 300 Hz to 3400 Hz included in the audio signal of the original narrow band are eliminated from the audio signal of the wide band frequencies of 300 Hz to 7000 Hz synthesized by the LPC synthesizing filter 11. An output of the band stop filter 14 is supplied to the adding circuit 5.

The components of the audio signal of the original narrow band of frequencies 300 Hz to 3400 Hz which was transmitted through the up-sampling circuit 3 and band pass filter 4 and the components of the audio synthesized audio signal of frequencies 3400 Hz to 7000 Hz which was transmitted through the band stop filter 14 are added in the adding circuit 5. Thus, a digital audio signal in which a frequency band lies within a range from 300 to 7000 Hz and a sampling frequency is equal to 16 kHz is derived. The digital audio signal is outputted from an output terminal 15.

As mentioned above, in the audio band width extending system to which the invention is applied, the input narrow band audio signal is analyzed by using the narrow band code book 6 and the wide band audio signal is synthesized by using the wide band code book 12. The autocorrelation is used as information of the code book. This is because although the LPC cepstrum has hitherto generally been used as spectrum envelope information, it has been found from the results of experiments that it is more auditorily preferable to use the autocorrelation which is not the logarithm scale rather than the case of using the LPC cepstrum. It is considered that this is because in the LPC cepstrum, since the logarithm scale is used, although the error is small in a consonant sound portion having a small power, the error is relatively large in a vowel sound portion having a large power.

In the audio bandwidth extending system to which the invention is applied, the signal in which the LPC residual is up-sampled and an aliasing distortion is generated and the high band side of the aliasing distortion is suppressed is used as an exciting source. By using such a signal, since the original audio power and a harmonic structure are preserved, a sufficient performance can be obtained as an exciting source.

As mentioned above, the autocorrelation is used as information of the code books 6 and 12, the signal in which the LPC residual is up-sampled and the high band side of the aliasing distortion is suppressed is used as an exciting source, and the audio signal is synthesized, so that a good wide band audio signal of 300 Hz to 7000 Hz can be derived from the LPC synthesizing filter 11.

In this manner, the wide band audio signal which is obtained from the LPC synthesizing filter 11 also includes the signal of the frequency components of the original band and the distortion is exerted on the frequency components of the original band by those processes. Therefore, if the output signal of the LPC synthesizing filter 11 is used as it is, an influence by the distortion of the frequency components of the original band occurs.

Therefore, the components of the original audio signal of 300 Hz to 3400 Hz which was extracted by eliminating the frequency components of the original band of 300 Hz to 3400 Hz from the output of the LPC synthesizing filter 11 by the band stop filter 14 and by transmitting the resultant signal through the band pass filter 4 and the components of the audio signal of 3400 Hz to 7000 Hz synthesized by the LPC synthesizing filter 11 are added.

In the distance calculation at the time of formation of the code book, a weighting process can be also performed in a manner such that a weight of data of a high degree is reduced. That is, in the narrow band code book 6, weights of degrees 1 to 3 are set to "1" and weights of degrees larger than 3 are set to "0". In the wide band code book 12, weights of degrees 1 to 6 are set to "1" and weights of degrees larger than 6 are set to "0". With this method, not only the memory capacity can be saved but also importance is attached to the reproduction of a coarse spectrum envelope as a nature of the autocorrelation parameters and an audio of a good quality can be obtained.

As mentioned above, if the wide band audio signal is formed by the LPC synthesis by using the autocorrelation as a code vector and by using the signal in which the LPC residual is up-sampled and the high band is suppressed as an exciting source, particularly, the fricative sound and affricate sound are lacking and a sound having a bad sharpness is obtained. Although a point that the prediction of the spectrum envelope is insufficient can be also mentioned as a cause, it is considered that it is mainly caused by the lack of power of the exciting source.

In the system to which the invention is applied, therefore, the affricate detecting circuit 7 to detect a fricative sound or affricate and the boosting circuit 10 for boosting the whole band or a part of the band of the exciting source when the fricative sound or affricate is detected are provided. The autocorrelation of degree 10 obtained in the LPC analyzing filter 2 is supplied to the affricate detecting circuit 7. In the affricate detecting circuit 7, whether the fricative sound or affricate has been inputted or not is detected by using the frame power of degree 0, autocorrelation of degree 1, and autocorrelation of degree 2 in the autocorrelation of degree 10. When the fricative sound or affricate is detected by the affricate detecting circuit 7, the whole band or a part of the band of the exciting source is boosted by the boosting circuit 10.

Figure 2:
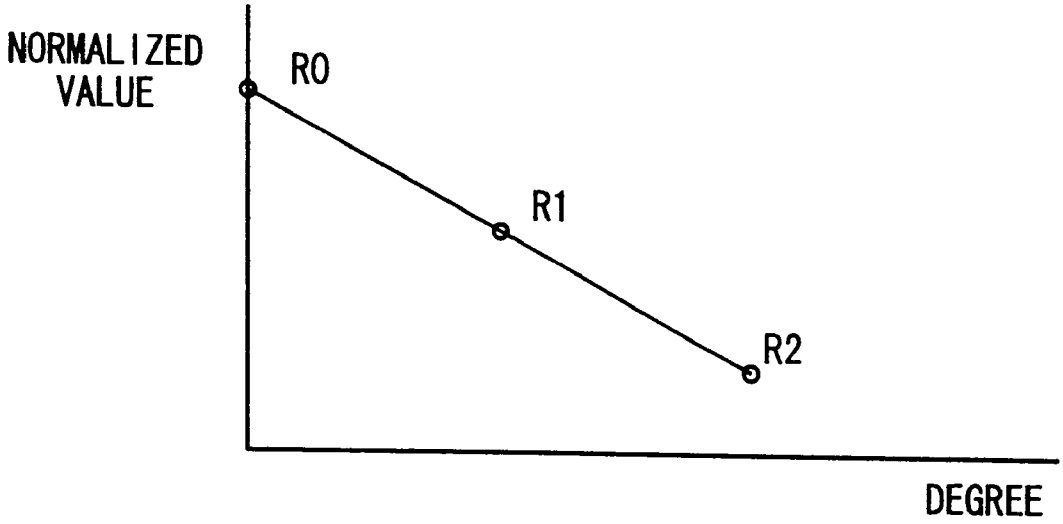
FIG. 2 is a graph which is used for explanation of the audio bandwidth extending system to which the invention is applied.
Figure 3:
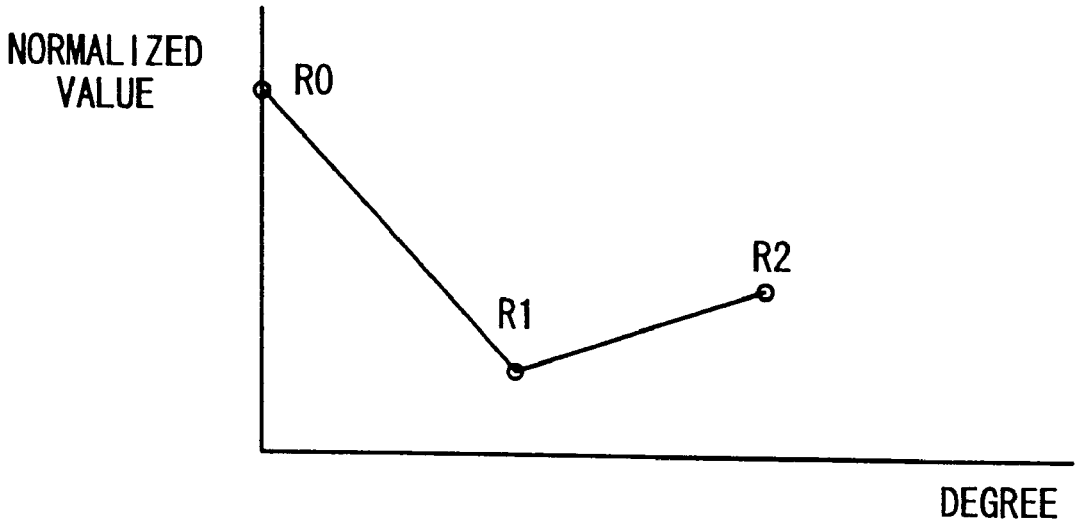
FIG. 3 is a graph which is used for explanation of the audio bandwidth extending system to which the invention is applied.

That is, as a result of the analysis of the autocorrelation of the input audio signal, it has been found that there are the following differences among the positional relations of the autocorrelation of degree 0, namely, the frame power, the autocorrelation of degree 1, and the autocorrelation of degree 2 in case of the vowel sound and the case of the fricative sound or affricate. In other words, assuming that the frame power of degree 0 is set to R0 and the autocorrelation of degree 1 is set to R1 and the autocorrelation of degree 2 is set to R2, as shown in FIG. 2, when the input audio signal is a vowel sound, the frame power R0 of degree 0, autocorrelation R1 of degree 1, and autocorrelation R2 of degree 2 are aligned on an almost straight line. On the other hand, as shown in FIG. 3, in case of the fricative sound or affricate, the frame power R0 of degree 0, autocorrelation R1 of degree 1, and autocorrelation R2 of degree 2 have a positional relation such that they are arranged on a line that is convex downward. Therefore, the fricative sound or affricate can be detected by discriminating whether the frame power R0 of degree 0, autocorrelation R1 of degree 1, and autocorrelation R2 of degree 2 have a positional relation such that they are arranged on a line that is convex downward.

By using the above relation, in the system to which the invention is applied, when the following conditions are satisfied, it is determined that there is the fricative sound or affricate.

Condition (1)

When

R0 is equal to or larger than a predetermined value, and

R1 is equal to or larger than a predetermined value, and

R1/R2 is equal to or less than a predetermined value, it is decided that there is the fricative sound or affricate.

Condition (2)

When

R0 is equal to or larger than a predetermined value and is equal to or less than a predetermined value, and R1 is equal to or less than a predetermined value, and

1−R1>R1−R2, it is determined that there is the fricative sound or affricate.

Condition (3)

When

R0 is equal to or larger than a predetermined value and is equal to or less than a predetermined value, and (R1−dc)/(R0−dc) is equal to or less than a predetermined value, and

1−R1>R1−R2, it is determined that there is the fricative sound or affricate. dc is set to a predetermined value every frame.

When it is determined by the condition (1) or (2) that there is the fricative sound or affricate, the exciting source is boosted by, for example, 10 dB. When it is decided by the condition (3) that there is the fricative sound or affricate, the exciting source is boosted by, for example, 5 dB.

When the above conditions are satisfied, if the exciting source is instantaneously boosted, the sound will suddenly change and a feeling of physical disorder will be given. Therefore, the exciting source is smoothly boosted a little every frame so as not to suddenly change the exciting source, thereby making the change in boost of the exciting source inconspicuous.

Figure 4A:
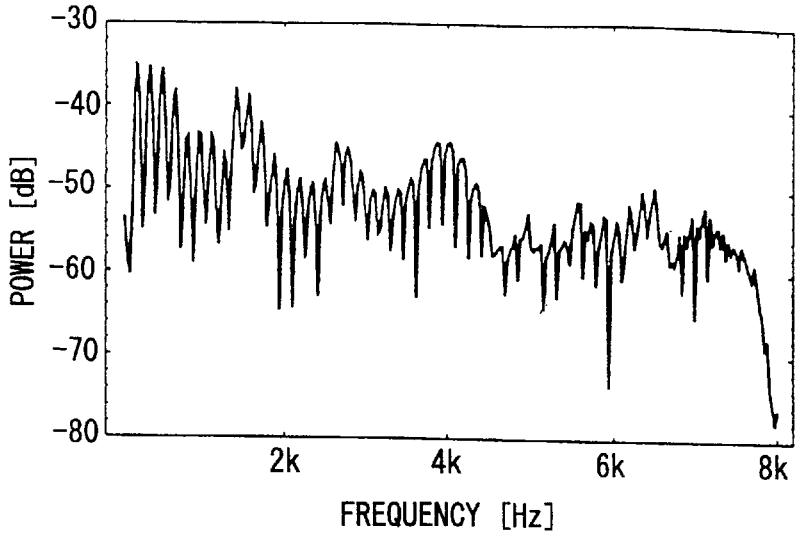
FIGS. 4A to 4C are spectrum diagrams which is used for explanation of effects of the audio bandwidth extending system to which the invention is applied.
Figure 4B:
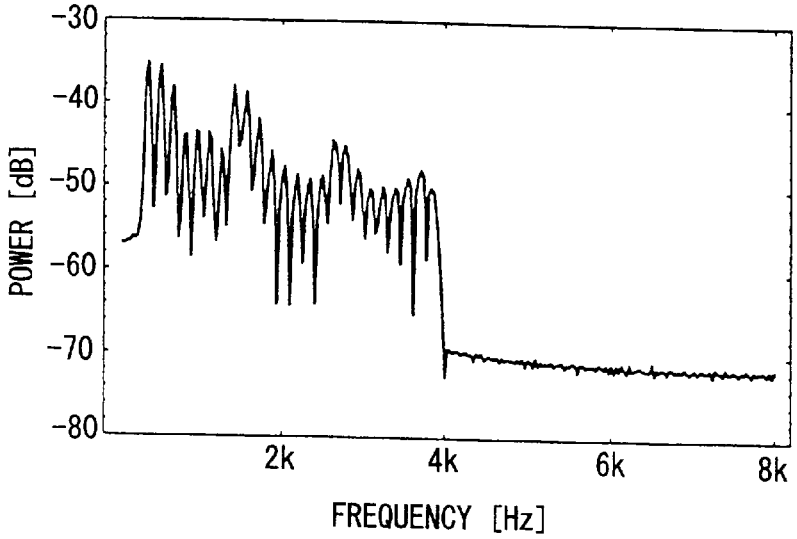
Figure 4C:
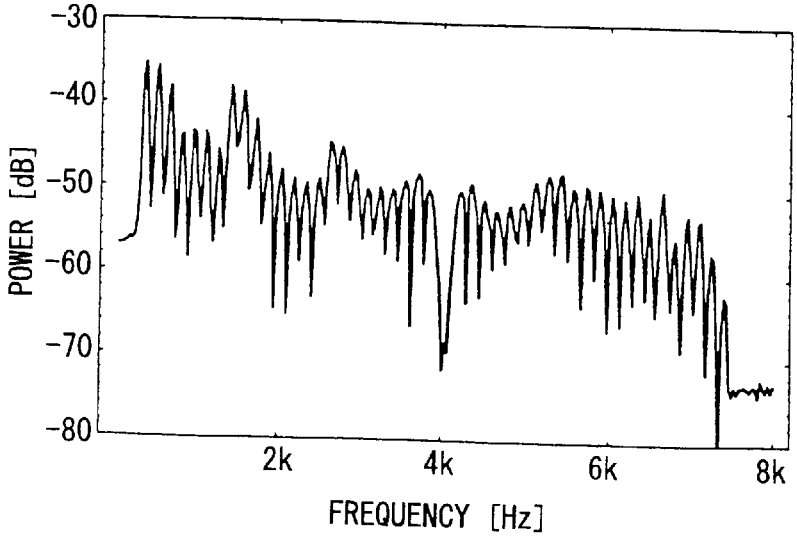

It will be obviously understood from the experiments that the audio bandwidth extension of good characteristics is executed by the audio bandwidth extending system to which the invention is applied. That is, FIGS. 4A to 4C show experimental results when the bandwidth extension of the audio signal is performed by using the audio bandwidth extending system to which the invention is applied. FIG. 4A is a spectrum diagram of the wide band audio signal serving as a source. It is assumed that the audio signal serving as a source is band limited as shown in FIG. 4B and the bandwidth extension is performed by the audio bandwidth extending system to which the invention is applied. FIG. 4C shows the audio signal obtained by performing the bandwidth extension of this signal. When comparing FIGS. 4A and 4C, it will be understood that the bandwidth extension of the audio signal could be performed at a high precision by the audio bandwidth extending system to which the invention is applied.

The invention can be used for improvement of a sound quality of an analog telephone line or improvement of a sound quality of a digital cellular phone. Particularly, in the digital cellular phone, the VSELP or PSI-CELP is used as a modulation system. Since the linear predictive coefficients and the exciting source are used in the VSELP or PSI-CELP, those information can be used at the time of an LPC analysis or LPC synthesis in the audio bandwidth extending system.

Figure 5:
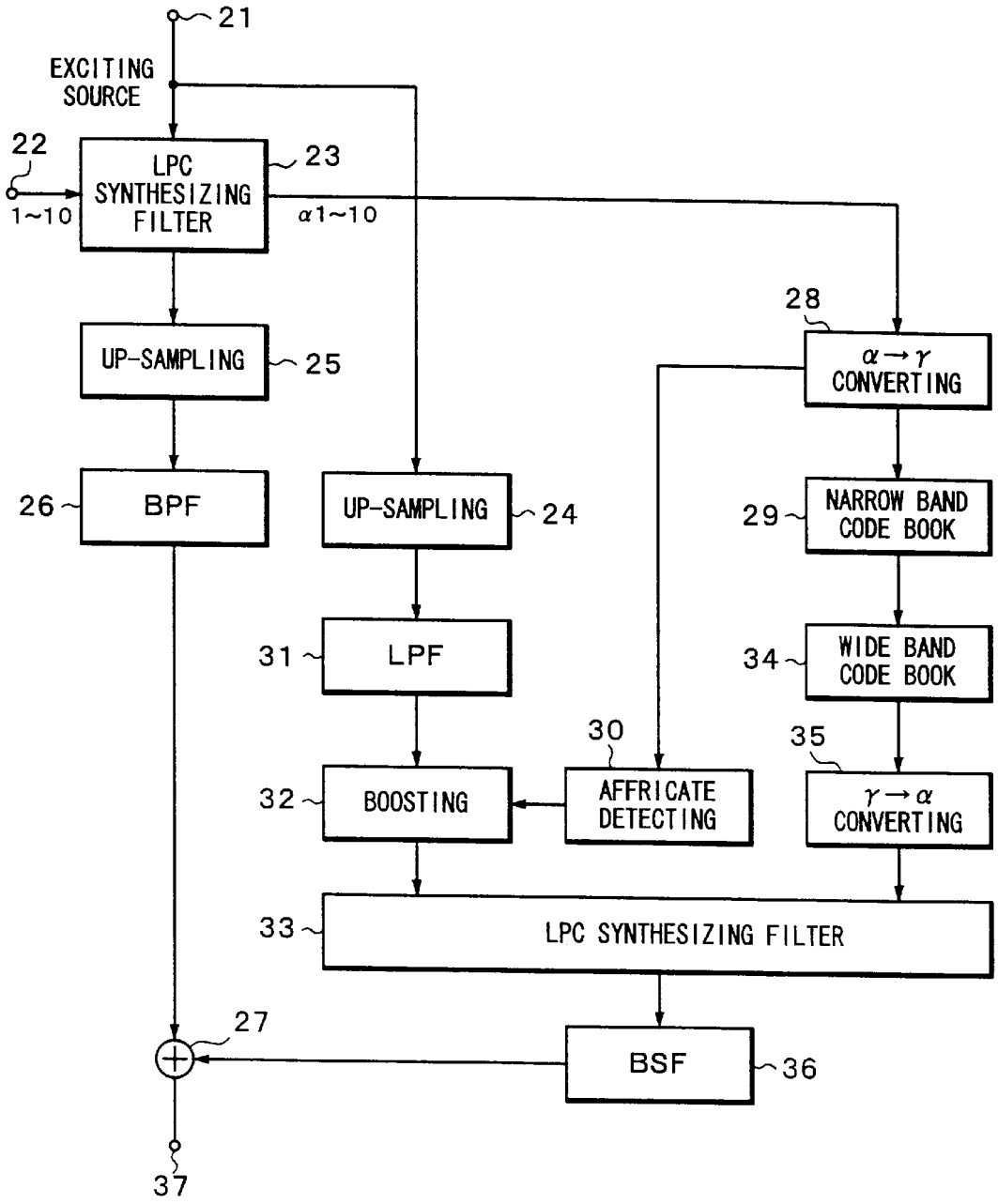
FIG. 5 is a block diagram showing an example in the case where the invention is applied to a cellular phone.
Figure 6:
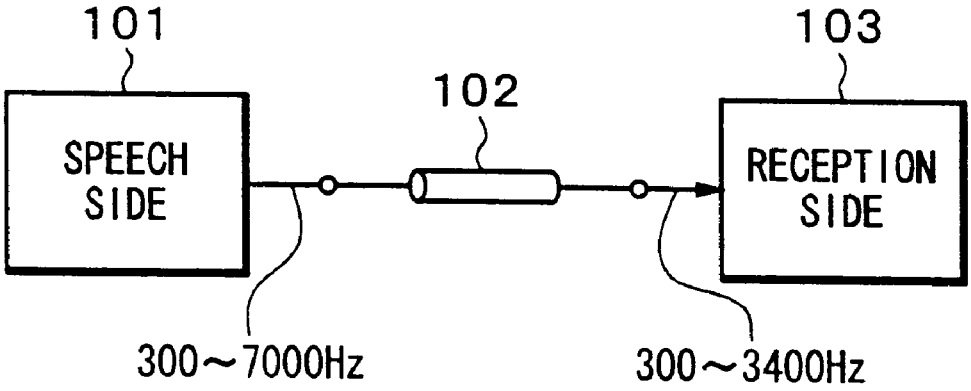
FIG. 6 is a block diagram which is used for explanation of an audio transmitting path in which a frequency band is limited.
Figure 7:
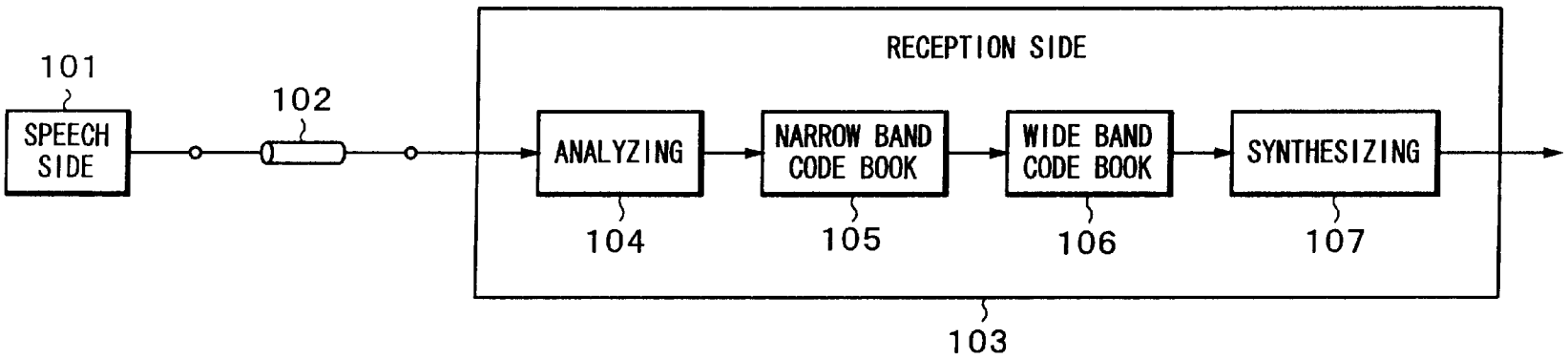
Fig. 7 (PRIOR ART)
FIG. 7 is a block diagram which is used for explanation of a conventional audio bandwidth extending system.

That is, FIG. 5 shows an application example in the digital cellular phone. As shown in FIG. 5, in the digital cellular phone, parameters which are equivalent to the exciting source and linear predictive coefficients $\alpha_1$ to $\alpha_{10}$ are sent. The exciting source is supplied to an input terminal 21 and the linear predictive coefficients are supplied to an input terminal 22. The exciting source from the input terminal 21 is sent to an LPC synthesizing filter 23 and is also transmitted to an up-sampling circuit 24. An autocorrelation coefficient from the input terminal 22 is sent to the LPC synthesizing filter 23.

In the LPC synthesizing filter 23, the audio signal is synthesized by using the linear predictive coefficients from the input terminal 22 on the basis of the exciting source from the input terminal 21. The audio signal synthesized by the LPC synthesizing filter 23 is supplied to an up-sampling circuit 25.

The up-sampling circuit 25 is used to up-sample a sampling frequency. An output of the up-sampling circuit 25 is supplied to an adding circuit 27 through a bandpass filter 26.

A path along the up-sampling circuit 25, band pass filter 26, and adding circuit 27 is a path for adding the signal of the components of the original frequency band to the synthesized audio signal.

The linear predictive coefficients are sent from the LPC synthesizing filter 23 to a linear predictive coefficient—autocorrelation converting circuit 28. The linear predictive coefficient—autocorrelation converting circuit 28 converts the linear predictive coefficients into an autocorrelation. The autocorrelation is sent to a narrow band code book 29 and is also supplied to an affricate detecting circuit 30.

The exciting source from the input terminal 21 is sent to an up-sampling circuit 24. An output of the up-sampling circuit 24 is sent to an LPC synthesizing filter 33 through a low pass filter 31 and a boosting circuit 32. The boosting circuit 32 is used to boost the exciting source when an affricate or fricative sound is detected. A boost amount of the boosting circuit 32 is controlled by an output of the affricate detecting circuit 30.

Autocorrelation information of a narrow band audio signal derived from patterns of a plurality of audio signals has previously been stored as code vectors in the narrow band code book 29. In the narrow band code book 29, the autocorrelation from the linear predictive coefficient—autocorrelation converting circuit 28 and the autocorrelation information stored in the narrow band code book 29 are compared, thereby performing a matching process. An index of the most matched autocorrelation information is sent to a wide band code book 34.

In correspondence to the narrow band code book 29, autocorrelation information of a wide band audio signal obtained from audio signals of the same patterns as those used when the narrow band code book 29 was formed has been stored in the wide band code book 34. When the most matched autocorrelation information is discriminated in the narrow band code book 29, its index is sent to the wide band code book 34. Autocorrelation information of a wide band corresponding to the autocorrelation information of a narrow band that is discriminated as being maximally matched is read out by the wide band code book 34.

The autocorrelation information of the wide band read out from the wide band code book 34 is sent to an autocorrelation—linear predictive coefficient converting circuit 35. The conversion from the autocorrelation to the linear predictive coefficients is executed by the autocorrelation—linear predictive coefficient converting circuit 35. The linear predictive coefficients are sent to the LPC synthesizing filter 33.

An LPC synthesis is performed in the LPC synthesizing filter 33. Thus, the wide band audio signal is synthesized. The audio signal synthesized by the LPC synthesizing filter 33 is supplied to a band stop filter 36. An output of the band stop filter 36 is supplied to the adding circuit 27.

The components of the audio signal of the original narrow band transmitted through the up-sampling circuit 25 and bandpass filter 26 and the components of the audio synthesized audio signal of the high band which was transmitted through the band stop filter 36 are added by the adding circuit 27. Thus, the wide band audio signal is derived. The audio signal is outputted from an output terminal 37.

As mentioned above, in the cellular phone system using the VSELP or PSI-CELP as a coding system, since the linear predictive coefficients and the exciting source are sent, the audio bandwidth can be extended by using that information.

According to the invention, the narrow band code book in which the parameters of the time region of the narrow band audio signal obtained from the patterns of a plurality of audio signals have previously been stored and the wide band code book in which the parameters of the time region of the wide band audio signal obtained from the patterns of a plurality of audio signals have previously been stored in correspondence to the code book of the narrow band are prepared, the analysis is performed by the code book of the narrow band, and the synthesis is executed by the code book of the wide band. The autocorrelation is used as parameters of the code books. At the time of audio synthesis, the signal obtained by up-sampling the LPC residual is used as an exciting source. By using the autocorrelation, the error in a vowel sound having a large power decreases and a good audio signal can be synthesized. Since the signal obtained by up-sampling the LPC residual is used as an exciting source, the exciting source approaches an ideal source and a good audio signal can be synthesized.

Having described specific preferred embodiments of the present invention with reference to the accompanying drawings, it is to be understood that the invention is not limited to those precise embodiments, and that various changes and modifications may be effected therein by one skilled in the art without departing from the scope or the spirit of the invention as defined in the appended claims.

What is claimed is:

1. An audio bandwidth extending system comprising:

analyzing means for obtaining autocorrelation coefficients and linear predictive coding residuals of a time region from a narrow band audio input signal;

exciting source signal forming means for forming an exciting source signal from said linear predictive coding residuals obtained by said analyzing means from the input narrow band audio signal;

affricate detecting means for detecting an affricate sound in said autocorrelation coefficients from said analyzing means and producing an output control signal;

boosting means for boosting a level of said exciting source signal in response to said output control signal from said affricate detecting means and producing a boosted exciting source signal;

a narrow band code book storing therein autocorrelation coefficients of the time region of the narrow band audio signal obtained from patterns of a plurality of audio signals and including matching means for comparing the autocorrelation coefficients of the time region of the narrow band audio input signal from said analyzing means with the autocorrelation coefficients of the time region of the narrow band audio signal stored in said narrow band code book and for retrieving optimum autocorrelation coefficients;

a wide band code book storing therein autocorrelation coefficients of a time region of a wide band audio signal obtained from patterns of said plurality of audio signals stored in correspondence to said narrow band code book and being addressed by said optimum autocorrelation coefficients from said narrow band code book;

converting means for converting corresponding autocorrelation coefficients from said wide band codebook to linear predictive coefficients; and synthesizing means for receiving the linear predictive coefficients from said converting means and for synthesizing an output wide band audio signal using the boosted exciting source signal from said boosting means and said linear predictive coefficients from said converting means as code vectors.

2. The audio bandwidth extending system according to claim 1, wherein said exciting source signal forming means forms said exciting source signal by using a signal obtained by up-sampling the linear predictive coding residuals of the input narrow band audio signal.

3. The audio bandwidth extending system according to claim 1, wherein said exciting source signal forming means forms said exciting source signal by using a signal obtained by up-sampling the linear predictive coding residuals of the input narrow band audio signal and comprises means for suppressing a high band in said exciting source signal.

4. The audio bandwidth extending system according to claim 1, wherein said exciting source signal forming means forms said exciting source signal by using a signal obtained by up-sampling the linear predictive coding residuals of the input narrow band audio signal and includes means for suppressing a high band in said exciting source signal.

5. The audio bandwidth extending system according to claim 1, wherein when said narrow band code book and said wide band code book are formed a weight of data of a high degree is reduced.

6. The audio band width extending system according to claim 1, wherein when said narrow band code book and said wide band code book are formed a weight of data of a high degree is set to "0".

7. An audio bandwidth extending method comprising the steps of:

providing a narrow band code book in which autocorrelation coefficients of a time region of a narrow band audio signal obtained from patterns of a plurality of audio signals have previously been stored;

providing a wide band code book in which autocorrelation coefficients of a time region of a wide band audio signal obtained from the patterns of said plurality of audio signals have previously been stored in correspondence to said narrow band code book;

obtaining autocorrelation coefficients and linear predictive coding residuals of a time region from an input narrow band audio signal;

forming an exciting source signal from said linear predictive coding residuals obtained from said input narrow band audio signal;

detecting an affricate sound in said autocorrelation coefficients from said step of obtaining and producing an output control signal;

boosting a level of said exciting source signal in response to said output control signal from said step of detecting and producing a boosted exciting source signal;

matching the autocorrelation coefficients of the time region of said audio signal of the input narrow band audio signal and the autocorrelation coefficients of the time region of the input narrow band audio signal stored in said narrow band code book and retrieving optimum autocorrelation coefficients by said matching;

reading out corresponding autocorrelation coefficients from the autocorrelation coefficients of the time region of the wide band audio signal stored in said wide band code book on the basis of the optimum autocorrelation coefficients retrieved by said matching;

converting corresponding autocorrelation coefficients from said wide band code book to linear predictive coefficients; and synthesizing an output wide band audio signal on the basis of said boosted exciting source signal from said step of boosting and said linear predictive coefficients acting as code vectors obtained in said step of reading out.

8. The audio bandwidth extending method according to claim 7, comprising the further step of using a signal obtained by upsampling the linear predictive coding residuals used to form said exciting source signal.

9. The audio bandwidth extending method according to claim 7, comprising the further steps of obtaining a signal by up-sampling the linear predictive coding residuals and suppressing a high band in said exciting source signal.

10. The audio bandwidth extending method according to claim 7, comprising the further steps of:

obtaining a signal by up-sampling the linear predictive coding residuals; and suppressing a high band in said exciting source signal.

11. The audio bandwidth extending method according to claim 7, further comprising reducing a weight of data of a high degree when said narrow band code book and said wide band code book are formed.

12. The audio bandwidth extending method according to claim 7, further comprising setting a weight of data of a high degree to "0" when said narrow band code book and said wide band code book are formed.

13. An audio bandwidth extending system for use in a digital cellular telephone system having a modulation system producing linear predictive coefficients and an exciting source signal from a narrow band audio signal, said bandwidth extending system comprising:

means for upsampling the exciting source signal and producing an upsampled exciting source signal;

first converting means for converting the linear prediction coefficients to autocorrelation coefficients;

a narrow band code book for storing therein autocorrelation coefficients of a time region of the narrow band audio signal obtained from patterns of a plurality of audio signals, wherein the stored autocorrelation coefficients are compared with the converted autocorrelation coefficients from the first converting means for producing a matching index;

a wide band code book for storing therein autocorrelation coefficients of a time region of a wide band audio signal obtained from patterns of said plurality of audio signals stored in correspondence to said narrow band code book and for receiving the matching index from said narrow band code book and reading out wide band autocorrelation coefficients in response thereto;

second converting means for converting said wide band autocorrelation coefficients read out from said wide band code book into autocorrelation coefficients for use as code vectors;

affricate detecting means for detecting an affricate sound in the autocorrelation coefficients converted to by said first converting means and producing an output control signal;

boosting means for boosting a level of said upsampled exciting source signal in response to said output control signal and producing a boosted exciting source signal; and a linear predictive coding synthesizing filter receiving the linear predictive coefficients from said second converting means and said boosted exciting source signal for synthesizing an output wide band audio signal from said boosted exciting source signal and said linear predictive coefficients as code vectors.

* * * * *